US007874253B2

(12) United States Patent
Marx

(10) Patent No.: US 7,874,253 B2
(45) Date of Patent: Jan. 25, 2011

(54) FIREARMS PROJECTILE

(75) Inventor: PJ Marx, Sarasota, FL (US)

(73) Assignee: Liberty Ammunition, LLC, Clearwater, FL (US)

( * ) Notice: Subject to any disclaimer, the term of this patent is extended or adjusted under 35 U.S.C. 154(b) by 0 days.

(21) Appl. No.: 12/775,208

(22) Filed: May 6, 2010

(65) Prior Publication Data

US 2010/0218696 A1 Sep. 2, 2010

Related U.S. Application Data

(62) Division of application No. 11/255,261, filed on Oct. 21, 2005, now Pat. No. 7,748,325.

(51) Int. Cl.
*F42B 14/02* (2006.01)
*F42B 30/02* (2006.01)

(52) U.S. Cl. ..... 102/517; 102/506; 102/524; 102/512; 102/513

(58) Field of Classification Search ..... 102/501, 102/506, 512, 513, 517, 524, 525, 526, 527
See application file for complete search history.

(56) References Cited

U.S. PATENT DOCUMENTS

| | | | |
|---|---|---|---|
| 29,272 | A | 7/1860 | Hotchkiss |
| RE1,247 | E | 12/1861 | Hotchkiss |
| 34,493 | A | 2/1862 | Havens |
| 36,197 | A | 8/1862 | Shaler et al. |
| RE1,410 | E | 2/1863 | Lindner |
| 40,153 | A | 10/1863 | Billings |
| 443,101 | A | 12/1890 | Maxim |
| 693,329 | A | 2/1902 | Neubauer |
| 998,712 | A | 7/1911 | McNair |
| 2,120,913 | A | 6/1938 | Studler |
| 2,322,751 | A | 6/1943 | Studler |
| 2,922,341 | A | 1/1960 | Treat, Jr. |
| 2,946,261 | A | 7/1960 | Crockett |
| 3,063,376 | A | 11/1962 | Powell |
| 3,142,256 | A | 7/1964 | Mack |
| 3,348,486 | A | 10/1967 | Rapp |

(Continued)

FOREIGN PATENT DOCUMENTS

| | | |
|---|---|---|
| FR | 1166011 | 1/1957 |

(Continued)

*Primary Examiner*—James S Bergin
(74) *Attorney, Agent, or Firm*—Anton J. Hopen; Smith & Hopen, P.A.

(57) ABSTRACT

A projectile structured to be discharged from a firearm includes a body having a nose portion and a tail portion separable from one another when the projectile strikes a target. The body further includes an interface disposed intermediate opposite ends of the body of the projectile structured to removably interconnect the nose and tail portions. Separation of the nose and tail portions such as when striking a soft tissue is caused by the tumbling of the projectile and the cooperative structuring of the interface to facilitate separation of the nose and tail portions. The interface is disposed, dimensioned and structured to define the primary area of contact of the projectile body with the rifling or interior surface of the barrel of the firearm. Another embodiment includes one of the nose or tail portions structured to contain a supplemental payload that is carried to the target upon discharge of the firearm.

11 Claims, 6 Drawing Sheets

U.S. PATENT DOCUMENTS

| | | | |
|---|---|---|---|
| 3,680,485 | A | 8/1972 | Zaid et al. |
| 3,713,386 | A | 1/1973 | Zaid |
| 3,913,489 | A | 10/1975 | Travor et al. |
| 3,939,773 | A | 2/1976 | Jenkins et al. |
| 3,952,657 | A | 4/1976 | Kaltmann |
| 4,112,846 | A | 9/1978 | Gilbert et al. |
| 4,128,059 | A | 12/1978 | Black |
| 4,242,960 | A | 1/1981 | Boeder et al. |
| 4,301,733 | A | 11/1981 | Arciniega Blanco |
| 4,431,150 | A | 2/1984 | Epperson, Jr. |
| 4,708,063 | A | 11/1987 | Ladriere |
| 4,836,108 | A | 6/1989 | Kegel et al. |
| 4,884,508 | A | 12/1989 | Kruse et al. |
| 4,939,996 | A | 7/1990 | Dinkha et al. |
| 5,097,767 | A | 3/1992 | Cirillo |
| 5,183,963 | A | 2/1993 | Beaufils et al. |
| 5,388,524 | A | 2/1995 | Strandli et al. |
| 5,686,693 | A | 11/1997 | Jakobsson |
| 6,085,630 | A | 7/2000 | Manis |
| 6,085,662 | A | 7/2000 | Nilsson |
| 6,305,293 | B1 | 10/2001 | Fry et al. |
| 6,317,946 | B1 | 11/2001 | Beal |
| 6,439,125 | B1 | 8/2002 | Carter |
| 6,502,516 | B1 | 1/2003 | Kinchin |
| 6,581,522 | B1 | 6/2003 | Julien et al. |
| 6,817,299 | B1 | 11/2004 | Cooke |
| 7,207,275 | B1 | 4/2007 | Oertwig |
| 7,219,607 | B2 | 5/2007 | Oertwig |
| 7,222,573 | B2 | 5/2007 | Pontieri |
| 7,451,706 | B2 | 11/2008 | Meyer |
| 2005/0183617 | A1 | 8/2005 | MacDougall |
| 2006/0027128 | A1 | 2/2006 | Hober |
| 2007/0089629 | A1 | 4/2007 | Marx |

FOREIGN PATENT DOCUMENTS

| | | |
|---|---|---|
| FR | 2662789 | 5/1990 |

FIREARMS PROJECTILE

CROSS-REFERENCE TO RELATED APPLICATIONS

This application is a division of and claims priority to U.S. application Ser. No. 11/255,261, entitled: "Firearms Projectile," filed Oct. 21, 2005 by the same inventor, which application is hereby incorporated by reference into this application.

BACKGROUND OF THE INVENTION

1. Field of the Invention

This invention is directed to projectile structured to be discharged from a firearm and comprising separable nose and tail portions and an interconnecting interface. The interface is structured to facilitate concurrent, synchronization rotation of the nose portion, the interface and the tail portion as the projectile travels through the bore of the firearm and as it exits therefrom. The interface is dimensioned and disposed to define a reduced contact area of the projectile body with the rifling or interior surface of the barrel of the firearm.

2. Description of the Prior Art

The latter part of the twentieth century brought environmental concerns into the ammunition field. The resulting changes included the United States military reducing the use of copper jacketed lead projectiles in an effort to reduce lead contamination. In addition, Oak Ridge National Laboratory was given the task of finding a lead free alternative to be used in the structuring and design of firearm projectiles. This research led to the development of a tungsten/tin compound known in the industry as "Green Bullet." Practical application and formation of this material involves tungsten powder bound together with tin or nylon and inserted into a jacket in place of the formerly used lead material. The performance characteristics of the resulting projectiles are equivalent to conventional lead filled projectiles but involve a significantly higher cost of production.

Accordingly, with the intended elimination or reduction in the use of lead in firearm projectiles there is a significant need in the firearm industry for a projectile capable of being tailored to assume various densities while distinguishing the weight of the projectile from its size. Currently, NATO 5.56 mm M855 (SS109) projectiles comprise a steel/lead core placed in a copper jacket which weighs 62 grains. Ideally, an improved projectile could be proposed and developed having the same physical dimensions but having an increased weight, of for example 107 grains or a 72 percent weight increase. In order to achieve the same weight utilizing the conventional jacketed lead projectile a significant change in the length of the projectile would have to be assumed. This additional length would decrease the space available for gun powder thereby reducing the propelling charge of the projectile. Moreover, the increased length in order to accomplish the desired increase in weight would also require a different rifling twist rate on the interior barrel surface of the firearm.

Accordingly, a desired and proposed improvement in projectiles would comprise an increase in the weight of the projectile with no decrease in case volume. Moreover, this would result in increased terminal energy which translates into energy delivered to the target upon impact of the projectile. More specifically, greater density means improved ballistic coefficient to the extent that an improved and proposed projectile would lose less of its initial velocity at long range target distances than jacketed lead or steel projectiles. As a result, an improved projectile would have increased accuracy as well as greater terminal energy and penetration characteristics.

Furthermore, an increased need in the firearms industry for an improved projectile would preferably involve a proposal which eliminates the use of a jacketed projectile. In contrast, a proposed projectile would have an exterior surface which engages the rifling along a reduced contact area as compared to conventional projectiles. Additional improvements may involve the use of a copper alloy in forming portions of the exterior surface of the projectile body. In the alternative, the exterior surface defining the contact area of the improved projectile could be made from other alloys or polymers. Therefore the design and structuring of a proposed projectile would result in a contact area thereon which would be significantly less than a traditional jacketed lead bullet. Accordingly, by reducing the contact area of the projectile, barrel friction would be significantly reduced. In turn, heat buildup would be reduced and the barrel performance during sustained fire of such projectiles would be greatly improved. Other advantages would involve the increase in barrel life of the firearm and reduced fouling. Additional performance characteristics of a proposed and improved projectile would provide significantly greater penetration when impacting hard targets such as armor, glass, vehicles, etc. than conventional jacketed lead projectiles. Additional physical characteristics of a proposed projectile would provide capabilities of delivering supplemental payloads while offering controlled fragmentation against soft targets (humans/animals).

Finally, the practical application and manufacturing associated with such a proposed preferred projectile in quantities adequate for the military and law enforcement needs would be significantly reduced due to the relative simplicity of the non-jacketed projectile, as proposed. Moreover, projectiles could be produced at a modest cost I especially as compared to the "Green Bullet" technology as briefly described above, while enabling the projectiles to be produced in all calibers generally ranging from 17 though 50 BMG while significantly improving the performance of all small caliber weapons systems.

SUMMARY OF THE INVENTION

The present invention is directed to a projectile structured to be discharged from a firearm and designed to overcome the disadvantages and problems associated with conventional firearm projectiles such as, but not limited to lead or steel jacketed projectiles.

Moreover, the projectile of the present invention eliminates the use of lead and the provision of an outer jacket. As such, specified portions of the exterior surface of the body of the projectile engage the rifling along an exterior surface area disposed and dimensioned to significantly reduce the area of contact of the projectile body with the rifling or interior surface of the barrel of the firearm. By reducing the contact area of the projectile, barrel friction is reduced thereby reducing heat buildup and improving barrel performance during sustained fire of the firearms. An additional benefit is the increase in barrel life and the reduction of fouling.

More specifically, the projectile of the present invention in one or more of the preferred embodiments to be described in greater detail hereinafter, comprises a body including a nose portion and a tail portion. In addition, the projectile body further includes an interface disposed intermediate opposite ends of the body and structured to interconnect the nose and tail portions in a manner which provides controlled fragmentation of the projectile body, especially when the projectile strikes a soft target. The disposition and structuring of the interface results in the positioning of an outer surface thereof so as to define the primary contact area between the body of the projectile and the rifling or interior surface of the barrel.

As set forth above, controlled fragmentation of the projectile, when striking at least a first predetermined target (soft material), is accomplished by the nose and tail portions of the projectile body being separable from one another. Such separation is facilitated by one or both of the nose and tail portions being removably attached or connected to the interface. Also, as will be explained in greater detail hereinafter, the interface is structured to rupture in certain instances such as, but not limited to, when the projectile strikes a predetermined target such as a human or animal target. More specifically, when the projectile body of the present invention penetrates a soft material target it begins to "tumble" typically resulting in the interface rupturing. As a result, the nose and tail portions separate from one another by means of the rupturing of the interface and/or the detachment of one or both of the nose and tail portions from the interface which may be facilitated by the rupturing of the interface.

Additional structural features of the projectile include at least one of the nose or tail portions, and preferably the tail portion, structured to contain and carry a supplemental payload for delivery to the target. Such supplemental payload may include, but are not limited to, Warfarin, Coumadin, Heparin, Lovenox and Fragmin, all of which are anti-coagulants. In addition, the supplement payload may include Isosorbide Dinitrate, Isosorbide Mononitrate and Hydralazine, all of which may be classified under the category of vasodilators. Additionally, the supplemental payload may include various isotopes for tracking such as RFI tags, SPLAT (Sticky Polymer Lethal Agent Tag), Smartdust, or other chemical agents. Therefore, the controlled fragmentation generally defined herein as a separation of the nose and tail portions of the projectile body will expose the targeted person, animal, etc, to the chemical agent defining the delivered payload, thereby resulting in the intended effect on the target.

The versatility of the manufacturing and performance characteristics of the projectile of the various embodiments of the present invention may also be attributed to the formation of the various nose and tail portions from high density metal matrix composites, metals or ceramics, wherein the interconnecting interface is preferably, but not necessarily, formed from a copper alloy. As a result, the projectile of the present invention may be produced on a mass scale using materials and manufacturing equipment currently available and known in the projectile, production industry. Accordingly, production can occur in a relatively short period of time from initial startup and at a relatively modest expense, especially when compared to customized projectiles currently under investigation. Finally, the subject projectile can be produced in virtually all calibers from .17 through 50 BMG and can significantly improve the performance of all small caliber weapons systems with which it is used.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 7:
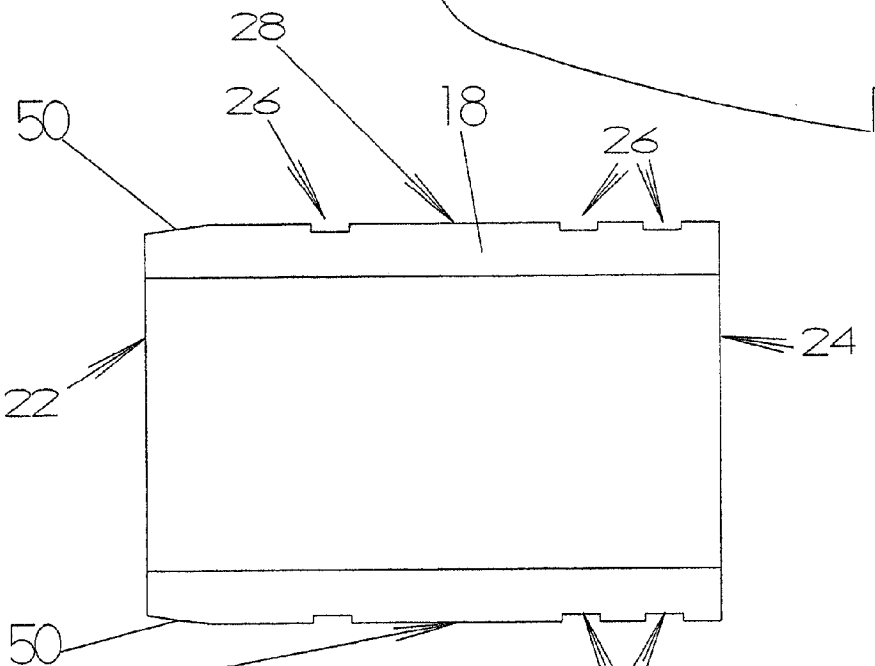
FIG. 7 is a sectional view in detail of yet another embodiment of an interface of the projectile as represented in FIGS. 1B and 1C.

As shown in the accompanying Figures, the present invention is directed to a projectile generally indicated as 10 of the type structured to be fired from a firearm. More specifically, the projectile 10 includes a body, generally indicated as 12, which comprises a nose portion 14 and a tail portion 16 shown in detail in FIGS. 2, 3, 5, and 6 respectively. In addition, the projectile body 12 includes an interface 18, shown in detail in FIGS. 4 and 7, disposed intermediate the opposite ends of the projectile body 12 in interconnecting relation to the head portion 14 and the tail portion 16 as demonstrated in FIG. 1.

Structural features associated with one or more preferred embodiments of the projectile 10 include the nose and tail portions 14 and 16 respectively, formed of high density metal matrix composites, metals, alloys, or ceramics. More specifically, the nose and tail portions 14 and 16 can each be formed from a material which contains one or more of the following: aluminum, antimony, beryllium, bismuth, boron carbide, brass, bronze, chromium, cobalt, copper, gold, iridium, iron, lead, magnesium, mercury, molybdenum, nickel, palladium, platinum, rhodium, silicon carbide, silver, steel, tantalum, tellurium, tin, titanium, tungsten, tungsten carbide, depleted uranium, zinc and zirconium.

The interface 18 may be made from a copper alloy similar to gilding metal. However, material from which the interface 18 is formed may vary to include other appropriate alloys, polymers, etc, including materials which contain one or more of the following: aluminum, bronze, brass, chromium, copper, epoxy, fiberglass, Kevlar, gold, graphite, iron, lead, magnesium, mercury, molybdenum, nickel, nylon, palladium, polycarbonate, polyester, polyethylene, polystyrene, polyamide, poly vinyl chloride, polyurethane, phenolic, thermoplastic polymer, thermoset polymer, rhodium, rubber, silicon, silver, steel, tantalum, tellurium, tin, titanium, Teflon, Torlon, Ultem, zinc, zirconium. As represented in both FIGS. 1 and 4, the interface 18 includes an at least partially hollow interior 20 and an open ended construction defined by at least one but preferably both oppositely disposed open ends 22 and 24. Other structural features of the interface 18 include an at least partially irregular exterior surface 28 including a plurality of recessed, spaced apart, annular grooves 26 integrally formed in the exterior surface 28.

A review of FIGS. 1, 1A, 1B and 1C clearly indicates that the interface 18, in each of the various preferred embodiments of the present invention, is disposed in interconnecting relation to both the nose portion 14 and the tail portion 16. As such, the open ended construction, comprising oppositely disposed open ends 22 and 24, as well as the at least partially hollow interior 20 are cooperatively dimensioned and configured to receive the connecting trailing section 14' of the nose portion 14 and the leading section 16' of the tail portion 16. Insertion of the nose and tail portions 14 and 16 and the fixed or removable connection to the interface 18 can be accomplished by a friction, press fitted securement as the connecting portions 14' and 16' pass into the at least partially hollow interior 20 through the open ends 24 and 22 of the interface 18.

Moreover, the press fitted insertion of the nose portion 14 and the tail portion 16 into the interface 18 may be structured to define either a fixed connection or a removable connection. With a firm, secure but removable connection, a separation of the nose and tail portions 14 and 16 from one another and possibly from the interface 18 is facilitated when the projectile body 12 strikes at least one predetermined category of targets such as, but not necessarily limited to, a soft target. More specifically, when the projectile body 12 penetrates a soft target (human, animal, etc.) it begins to "tumble." Due at least in part to the forces exerted on the projectile body 12 and the structural features of the interface 18 during such tumbling, the interface 18 will separate or rupture.

As set forth above, the connection between the interface 18 and the nose and tail portions 14 and 16 may be fixed. As such, the nose and tail portions 14 and 16 separate from one another by the fact that the interface 18 ruptures upon striking the target and/or during the tumbling procedure. Accordingly, the structural and operational features of the projectile 10 provide a controlled fragmentation when the projectile body 12 strikes at least a predetermined target, such as a soft material target including a human, animal, etc. At the same time, the projectile 10 provides significantly greater penetration against hard targets than jacketed lead/steel projectiles as conventionally structured. Yet another feature associated with the various preferred embodiments of the present invention is the existence of a firm, secure interconnection between the interface 18 and each of the nose and tail portions 14 and 16 respectively. Such a secure connection or attachment between the nose portion 14, the interface 18 and the tail portion 16 will assure that all these components rotate with one another as the projectile passes through the barrel and thereafter as the projectile exits the barrel. Such rotation is further defined by the nose portion 14, interface 18 and tail portion 16 all rotating in a common direction and in a synchronized manner such that rotation of all portions of the projectile rotate while being fixedly secured to one another such that the rotation of the projectile is synchronized. Moreover, any movement or "slippage" of the nose portion 14, interface 18 and tail portion 16 relative to one another during the flight of the projectile is prevented as the projectile rotates during travel through the barrel and during flight thereafter.

Figure 1:
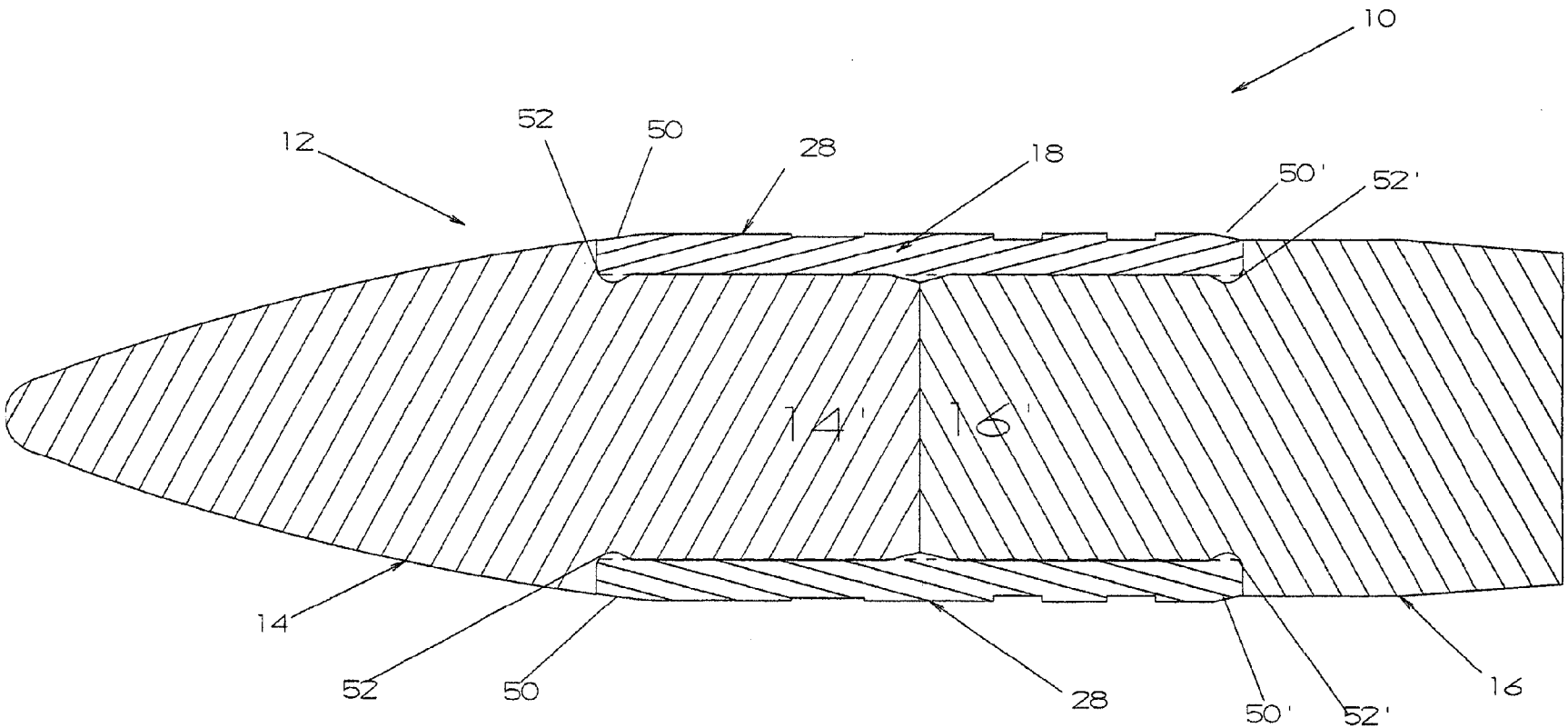
FIG. 1 is a sectional view of one preferred embodiment of the projectile of the present invention.
Figure 1A:
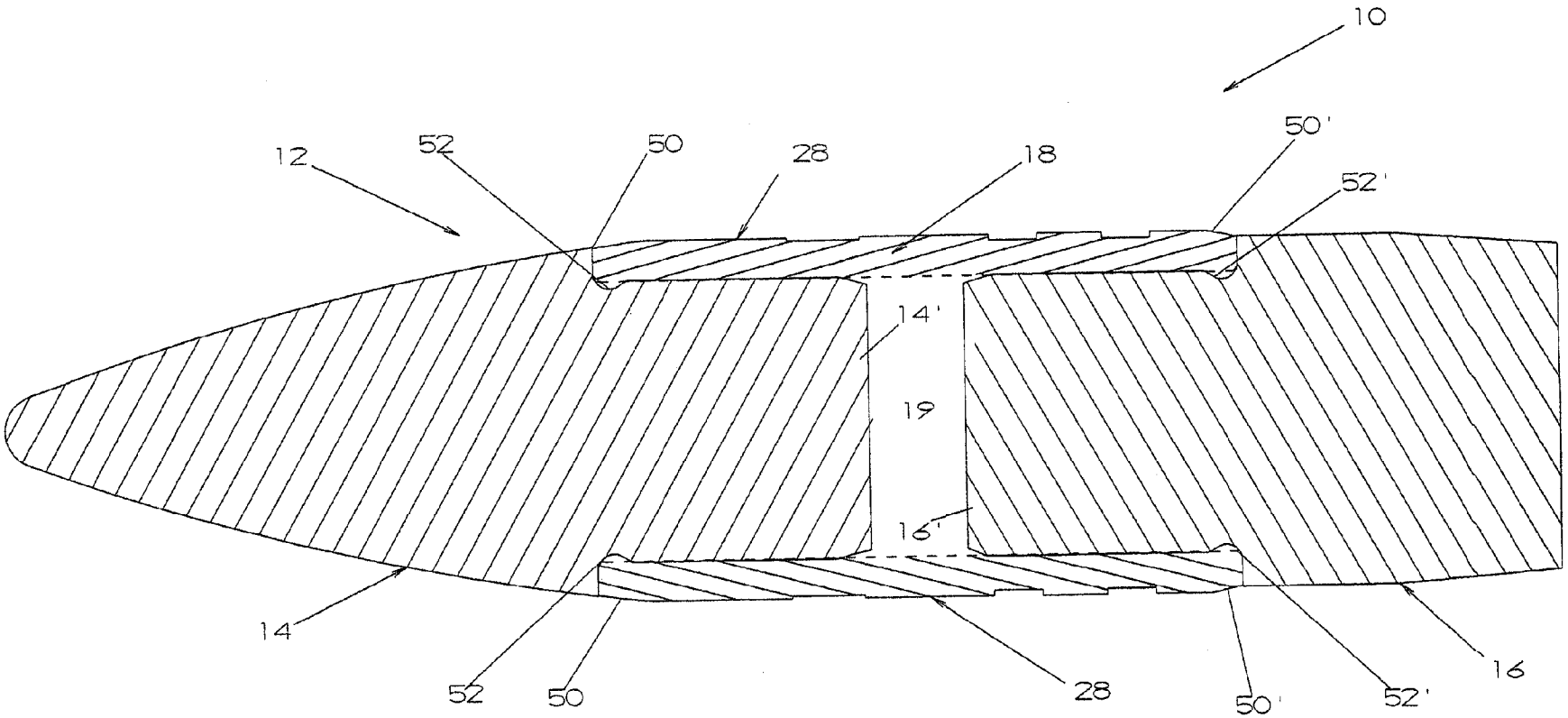
FIG. 1A is a sectional view of yet another preferred embodiment of the projectile of the present invention.
Figure 1B:
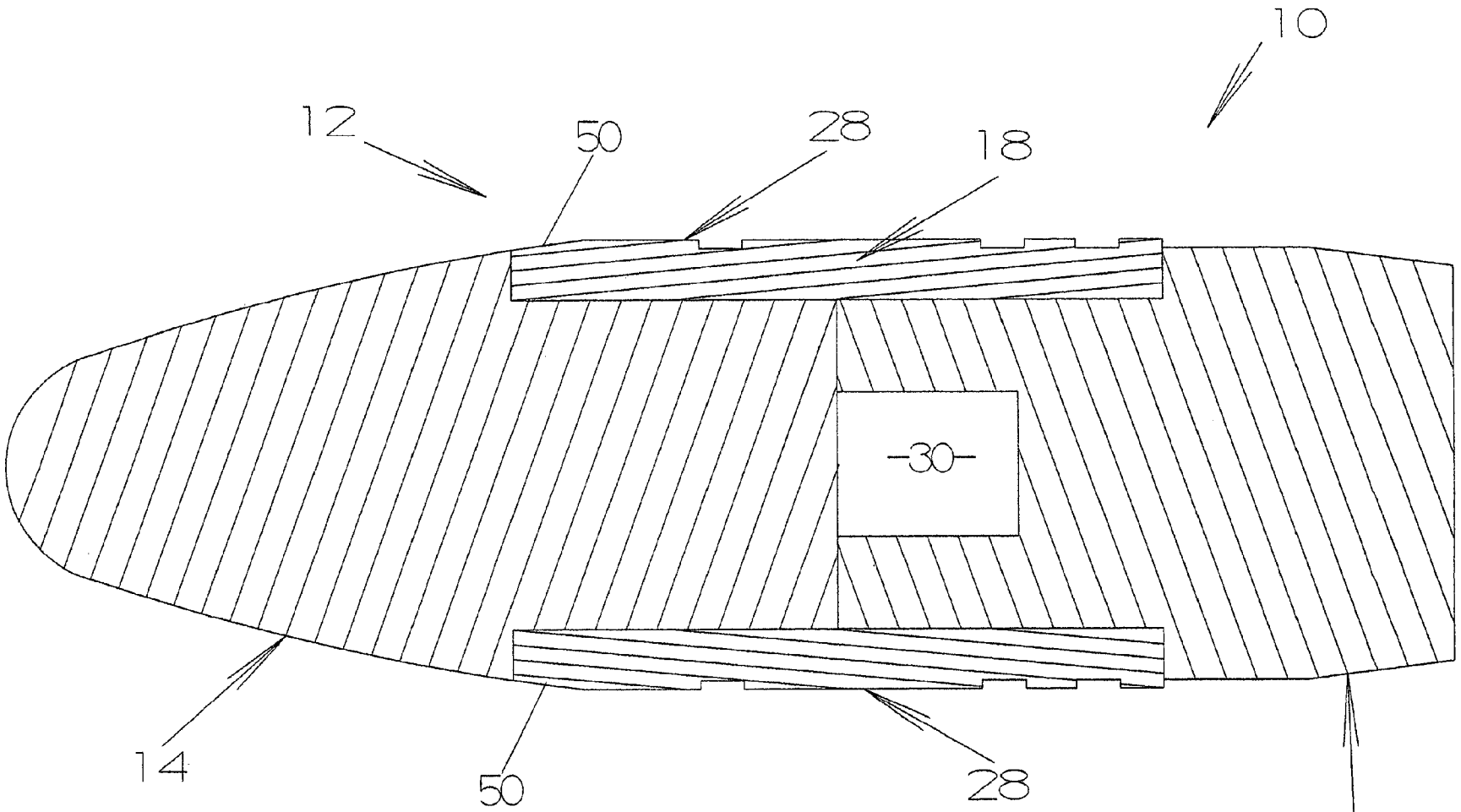
FIG. 1B is a sectional view of yet another preferred embodiment of the projectile of the present invention.
Figure 1C:
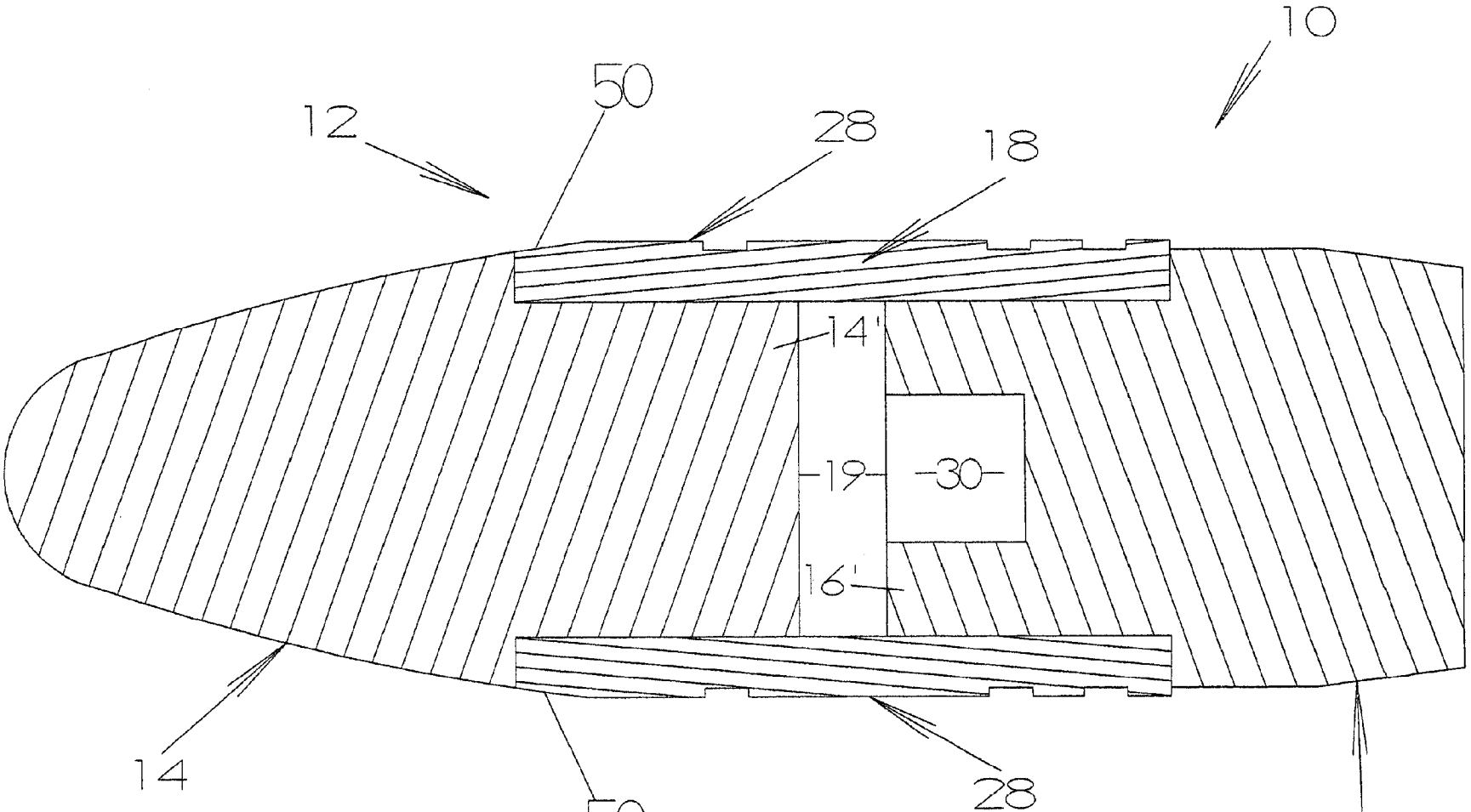
FIG. 1C is a sectional view of yet another preferred embodiment of the projectile of the present invention.
Figure 2:
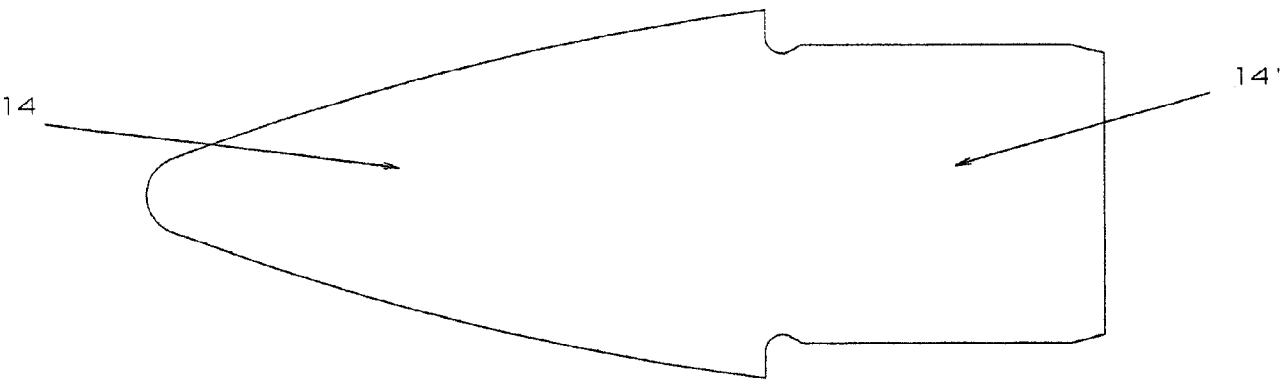
FIG. 2 is a side view of a head portion of the embodiment of the projectile of FIG. 1.
Figure 3:
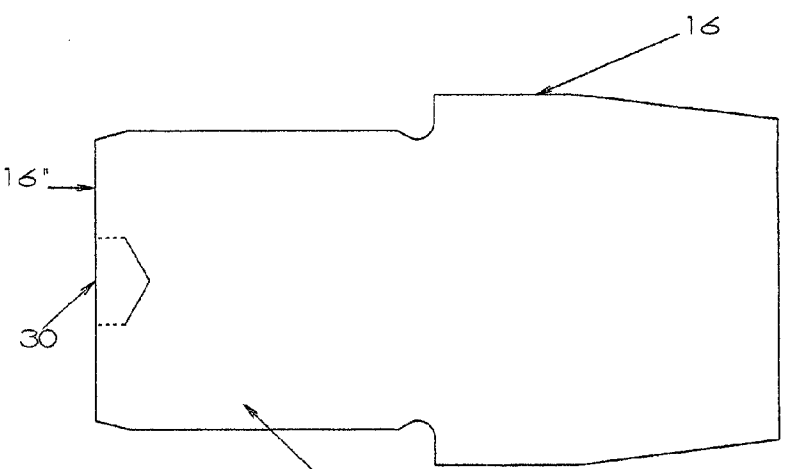
FIG. 3 is a side view of another embodiment of a tail portion of the projectile which could be incorporated in the embodiment of FIG. 1.

It should be noted that distinguishing features of the various preferred embodiments as represented in FIG. 1 through comprises a different configuration and/or dimension of the nose portion 14, tail portion 16 and interface 18. Further, as can be seen throughout a representation of the structural and dimensional modifications of the various preferred embodiments of the present invention, the nose and tail portions have a combined length equal to one hundred percent of the length of the projectile as clearly demonstrated in FIGS. 1 and 1B. However, as represented in FIGS. 1A and 1B, the embodiments disclosed therein include a predetermined spacing as at 19 existing between the corresponding ends or faces of the trailing section 14' of the nose portion 14 and the leading section 16' of the tail portion 16. As such, the combined length of the nose and tail portions may be eighty to ninety percent or greater than the total length of the projectile with the provision of the spacing 19. Further, in at least one additional preferred embodiment, the trailing section 14' of the nose portion 14 and the leading section 16' of the tail portion 16 are spaced apart a distance of 0.060 inches or less when the projectile is completely assembled in the form demonstrated in FIGS. 1A and 1C. As is also clearly represented, FIGS. 1 and 1B represent different preferred embodiments of the present invention, wherein correspondingly disposed ends or faces of the trailing portion 14' and the leading portion 16' are disposed in confronting engagement with one another on the interior of the interface thereby eliminating the presence of the spacing 19 as represented in FIGS. 1A and 1C.

Additional dimensional features directed to the structure of the projectile 10, the body 12 and its various components comprise the nose portion 14 having a greater overall length than that of the interface 18. Further, the overall length of the tail portion is equal to or greater than fifty percent of the overall length of the interface 18. Further, the length of the trailing section 14' and the leading section 16' which are disposed and connected on the interior of the interface 18 each represent between thirty percent and seventy percent of the overall length of the interface 18. Comparatively, in at least one embodiment, the length of the interface 18 comprises between thirty to seventy percent of the overall length of the projectile 10.

As with the structural dimensions of the body 12 and the various components associated therewith, the density of the projectile may vary such that average total density of the nose portion 14, tail portion 16 and interface 18 collectively comprise a density that is greater than 11.5 grams per cubic centimeter. A lighter version of the same projectile may be defined, wherein an average total density of the nose portion 14, tail portion and interface 18 collectively include a density greater than 7 grams per cubic centimeter.

Another operative feature of at least additional preferred embodiments of the projectile 10, such as represented in Figures comprises the provision of a recess or cavity generally indicated as 30 in at least one of the nose and tail portions 14 and 16 and preferably in the tail portion 16. In a most preferred embodiment, the recess or cavity 30 is formed adjacent or contiguous to the front or end face 16" of the leading section 16' of the tail portion 16 and is dimensioned and configured to contain a supplemental payload. The supplemental payload may comprise any chemical or other material agent specifically intended to affect the target struck by the projectile body 12. Moreover, possible payloads include anticoagulants such as, but not limited to, Warfarin, Coumadin, Heparin, Lovenox and Fragmin. In addition, the chemical agents defining the supplemental payload may include vasodilators including Isosorbide Dinitrate, Isosorbide Mononitrate and Hydralazine. Also the payload may comprise various isotopes for tracking a target including RFI tags, SPLAT (Sticky Polymer Lethal Agent Tag), Smartdust and a variety of other materials. Structuring of the tail portion 16 to include the supplemental payload in cooperation with the structuring of the other components with the projectile body 12 which facilitates the aforementioned controlled fragmentation facilitate the delivery of the supplemental payload to the intended target. As should be apparent, a separation of the nose portion 14 and the tail portion 16 by detachment of the interface 18 or the rupturing thereof will expose the supplemental payload to the target penetrated by the projectile body 12.

Also, it is emphasized that the projectile body 12 is not jacketed as in conventional copper jacketed projectiles. However, an additional operative feature of the interface 18 in accord with its disposition and structure is directed to the exterior surface 28 thereof which defines a reduced, primary contact and/or substantially exclusive contact area between the projectile body 12 and the rifling or interior surface of the barrel of the firearm from which it is discharged. The significantly reduced area of contact between the projectile body and the rifling of the barrel, than that of a traditional jacketed bullet, results in significantly reduced bore friction and heat buildup. As a result, barrel performance is improved during sustained fire of the firearm thereby increasing the barrel life and reducing the occurrence of fouling.

Figure 4:
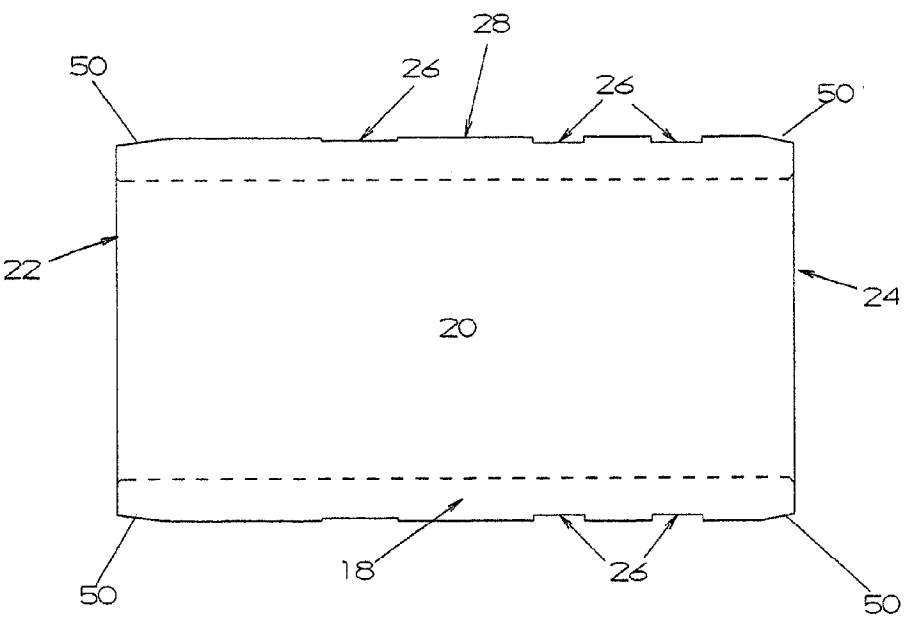
FIG. 4 is a side view in detail of an interface component of the preferred embodiment of FIG. 1.
Figure 5:
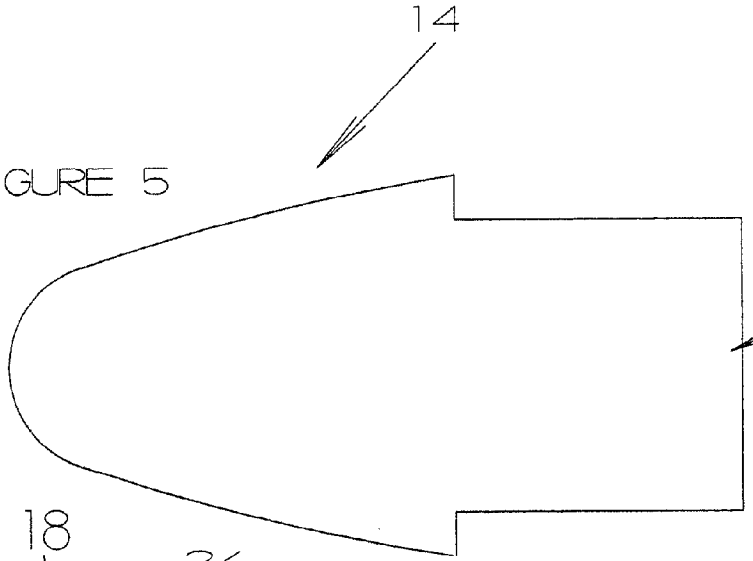
FIG. 5 is a side view of a head portion of the projectile of the embodiment of FIGS. 1B and 1C.
Figure 6:
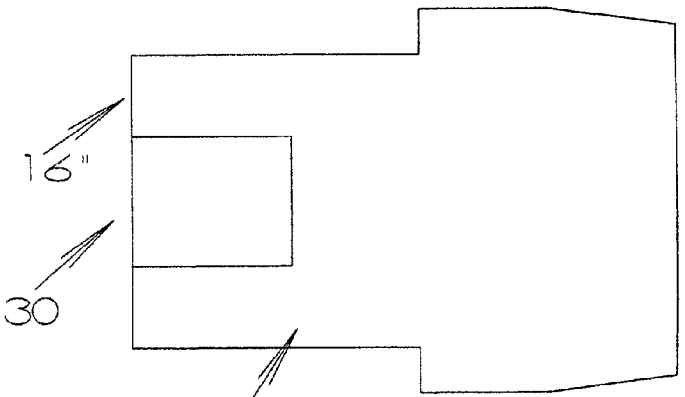
FIG. 6 is a side view of another embodiment of the tail portion of the projectile similar to the embodiment of FIGS. 1B and 1C.

Yet another feature of one or more of the preferred embodiments of the present invention includes the interface 18 having a tapered or other appropriate configuration generally indicated as 50 located at least at one end thereof. As such, the tapered configuration 50 facilitates or aids in the aerodynamic configuration of the entire projectile 10 thereby facilitating the flight of the projectile 10 after it leaves the barrel of the firearm. Further, in additional preferred embodiments of the present invention such as represented in FIGS. 1, 1A and 4, the interface 18 includes both end portions as at 50 and 50' having the aforementioned tapered configuration. Such tapered configuration not only facilitates the aerodynamic flight of the projectile 10, but further serves to at least partially enclose and facilitate gripping engagement of the interface 18 with the nose portion 14 and tail portion 16 as the trailing section 14' and the leading section 16' are connected to and extend within the interior of the interface 18.

Reference is also directed to the embodiment of FIGS. 1 and 1A wherein secure and fixed engagement between the interface 18 and the nose portion 14 and tail portion 16 is facilitated by the inwardly directed, somewhat interior peripheral rims 52 and 52' located at opposite ends of the interface 18. The peripheral rims 52 and 52' are used to maintain a fixed secure engagement between the interface 18 and the nose and tail portions 14 and 16. As set forth above, such fixed engagement aids in the concurrent, synchronized rotation of the nose portion 14, the interface 18 and the tail portion 16 as the projectile 10 travels through the bore of the firearm and as it exits therefrom. Finally, structural and operative features of the projectile 10, including the cooperative components of the nose portion 14, tail portion 16 and interface 18, overcome many of the disadvantages and problems normally associated with conventional firearm projectiles through the provision of a non-jacketed structure and the elimination of lead. Moreover, the versatility of the projectile of the present invention is demonstrated by providing controlled fragmentation against soft targets and the delivery of a variety of supplemental payloads.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents. Now that the invention has been described,

What is claimed is:

1. A projectile structured to be discharged from a firearm, said projectile comprising:

a body comprising a nose portion and a tail portion, said body further including an interface portion disposed intermediate opposite ends of said body in interconnecting relation to said nose and tail portions, said interface portion structured to provide controlled rupturing of said interface portion responsive to said projectile striking a predetermined target, said interface portion disposed and dimensioned to define a reduced area of contact of said body with the rifling of the firearm, said interface portion maintaining the nose portion and tail portion in synchronized rotation while being fixedly secured to one another by said interface portion whereby upon said projectile striking said predetermined target said interface portion ruptures thereby separatine said nose and tail portions of said projectile; and and at least one of said nose and tail portion structured to carry a supplemental payload.

2. A projectile as recited in claim 1 wherein said body is structured. to separate said nose and tail portions and expose the supplemental payload upon said body striking a predetermined target.

3. A projectile as recited in claim 2 wherein said body is further structured to separate said nose and tail portions at a location adjacent said interface.

4. A projectile as recited in claim 3 wherein said interface is removably connected to said nose and tail portions.

5. A projectile as recited in claim 3 wherein said interface is rupturable upon said body striking at least a predetermined target.

6. A projectile as recited in claim 1 wherein said tail portion is structured to carry the supplemental payload.

7. A projectile as recited in claim 6 wherein said tail portion comprises a cavity formed therein, said cavity dimensioned and configured to contain the supplemental payload.

8. A projectile as recited in claim 7 wherein said cavity is disposed adjacent a front face of said tail portion.

9. A projectile as recited in claim 7 wherein said cavity is disposed adjacent said interface.

10. A projectile as recited in claim 9 wherein said tail portion is at least partially separable from said interface to expose the supplemental payload.

11. A projectile as recited in claim 10 wherein said interface is rupturable upon striking a predetermined target.

* * * * *